US009297148B2

(12) United States Patent
Stulen et al.

(10) Patent No.: US 9,297,148 B2
(45) Date of Patent: Mar. 29, 2016

(54) INTELLIGENT BOOM CONTROL HYDRAULIC SYSTEM

(71) Applicant: Deere & Company, Moline, IL (US)

(72) Inventors: Henry J. Stulen, Paris (CA); Calin Raszga, Dubuque, IA (US)

(73) Assignee: Deere and Company, Moline, IL (US)

( * ) Notice: Subject to any disclaimer, the term of this patent is extended or adjusted under 35 U.S.C. 154(b) by 434 days.

(21) Appl. No.: 13/949,355

(22) Filed: Jul. 24, 2013

(65) Prior Publication Data

US 2015/0030424 A1 Jan. 29, 2015

(51) Int. Cl.

| | |
|---|---|
| ***E02F 3/43*** | (2006.01) |
| ***E02F 9/22*** | (2006.01) |
| ***B66C 23/00*** | (2006.01) |
| *F15B 21/14* | (2006.01) |

(52) U.S. Cl.

CPC ..... *E02F 9/2217* (2013.01); *B66C 23/54* (2013.01); *E02F 3/436* (2013.01); *E02F 9/2296* (2013.01); *F15B 21/14* (2013.01); *F15B 2211/20546* (2013.01); *F15B 2211/3059* (2013.01); *F15B 2211/50581* (2013.01); *F15B 2211/6658* (2013.01); *F15B 2211/88* (2013.01)

(58) Field of Classification Search

CPC ..... B66C 23/54; B66C 23/82; E02F 3/435; E02F 3/436; E02F 3/437; E02F 9/2217; E02F 9/2278; E02F 9/2296; F15B 21/14; F15B 2211/20546; F15B 2211/3059; F15B 2211/50581; F15B 2211/6658

See application file for complete search history.

(56) References Cited

U.S. PATENT DOCUMENTS

| | | | | |
|---|---|---|---|---|
| 3,583,585 | A | 6/1971 | Joyce | |
| 3,960,284 | A | 6/1976 | Carpenter | |
| 4,898,219 | A | 2/1990 | Pomies | |
| 5,293,914 | A | 3/1994 | Hudson | |
| 6,443,196 | B1 | 9/2002 | Kurelek | |
| 6,557,453 | B2 | 5/2003 | Paakkunainen | |
| 6,681,818 | B2 | 1/2004 | Kurelek | |
| 6,763,863 | B2 | 7/2004 | Liu | |
| 6,997,221 | B2 | 2/2006 | Kurelek | |
| 7,007,728 | B2 | 3/2006 | Kurelek | |
| 7,878,347 | B2 | 2/2011 | Alday | |
| 8,919,114 | B2 * | 12/2014 | Edler | E02F 9/2289 60/422 |

* cited by examiner

*Primary Examiner* — Dwayne J White
*Assistant Examiner* — Logan Kraft
(74) *Attorney, Agent, or Firm* — Taft Stettinius & Hollister LLP; Stephen F. Rost

(57) ABSTRACT

An intelligent knuckle boom control system is disclosed where hoist and stick cylinders raise and lower main and stick booms, respectively, a base end control valve controls flow to the hoist and stick cylinder base ends, a hoist rod control valve controls flow to the hoist cylinder rod end, and a stick rod control valve controls flow to the stick cylinder rod end. A microprocessor computes control signals to direct flow through the control valves based on operator commands and boom position readings. The system can include an energy storage system for storing excess energy and releasing the stored energy, where the microprocessor directs storage of excess energy and release of stored energy. The energy storage system can include a hydraulic accumulator, an accumulator control valve and hydraulic pressure sensors; where the microprocessor receives pressure sensor readings and computes accumulator control valve control signals.

20 Claims, 4 Drawing Sheets

INTELLIGENT BOOM CONTROL HYDRAULIC SYSTEM

FIELD OF THE INVENTION

The present invention generally relates to the field of motorized machinery, and more specifically to a hydraulic circuit for a machine with a knuckle boom powered by hydraulic cylinders.

BACKGROUND OF THE INVENTION

When operating conventional knuckle boom systems today, there are inefficiencies in the system whenever the boom and any lifted load is lowered, i.e. a reduction in their potential energy is dissipated by metering hydraulic oil through an orifice and converting the energy into heat which goes into the machine's hydraulic oil. Cooling systems need to be added to the machine to expel this heat to ambient air so the hydraulic oil does not overheat.

Mechanical-hydraulic systems have inherent kinematic limitations when operated by controlling cylinder speeds. The knuckle boom is a non-linear kinematic system where approximating constant boom system endpoint trajectories and velocities can be challenging. To raise a boom and load, typically diesel fuel or electricity is used as an energy source and converted to hydraulic power through diesel engines, electric motors and/or hydraulic pumps. This energy, in the form of hydraulic oil pressure and flow, is directed to the hydraulic cylinders by control valves which may be commanded by a human operator and/or an automated routine. There can be instances in a boom system where one or more booms are being raised and lowered simultaneously. It would be desirable to transfer energy from the lowering boom(s) and load(s) to the boom(s) and load(s) being raised in all operating modes.

SUMMARY

A system is disclosed for improving the hydraulic operating efficiency of knuckle boom systems in all operating modes and/or simplifying the boom control inputs such that less skilled operators will be more productive and all operators will experience reduced fatigue from extended periods of operation, again resulting in productivity improvements.

An intelligent boom control hydraulic system is disclosed for a knuckle boom system including a main boom and a stick boom coupled at a knuckle. The intelligent boom control hydraulic system includes hoist and stick hydraulic cylinders, hoist and stick boom position sensors, a hydraulic fluid pump, a hydraulic reservoir with hydraulic fluid, a base end control valve, a hoist rod control valve, a stick rod control valve, an operator input device for input of operator commands, and a microprocessor. The hoist hydraulic cylinder raises and lowers the main boom, and the stick hydraulic cylinder raises and lowers the stick boom. Each of the hoist and stick hydraulic cylinders has a rod end and a base end. The hoist boom position sensor provides hoist boom position readings, and the stick boom position sensor provides stick boom position readings. The base end control valve controls flow from the hydraulic fluid pump to the base ends of the hoist and stick hydraulic cylinders, and controls flow from the base ends of the hoist and stick hydraulic cylinders to the hydraulic reservoir. The hoist rod control valve controls flow from the hydraulic fluid pump to the rod end of the hoist hydraulic cylinder, and controls flow from the rod end of the hoist hydraulic cylinder to the hydraulic reservoir. The stick rod control valve controls flow from the hydraulic fluid pump to the rod end of the stick hydraulic cylinder, and controls flow from the rod end of the stick hydraulic cylinder to the hydraulic reservoir. The microprocessor computes control signals to direct flow through the base end control valve, the hoist rod control valve and the stick rod control valve based on the operator commands and the hoist and stick boom position readings. During operation at least two of the base end control valve, the hoist rod control valve and the stick rod control valve can be activated, one of the activated valves coupling the stick or hoist hydraulic cylinder to the hydraulic fluid pump and the other of the activated valves coupling the stick or hoist hydraulic cylinder to the hydraulic reservoir.

The hoist boom position sensor can be a hoist cylinder position sensor that determines the length of the hoist hydraulic cylinder. The stick boom position sensor can be a stick cylinder position sensor that determines the length of the stick hydraulic cylinder.

The intelligent boom control hydraulic system can also include a hoist counter-balance valve that controls flow between the base end control valve and the base end of the hoist hydraulic cylinder. The intelligent boom control hydraulic system can also include a stick counter-balance valve that controls flow between the base end control valve and the base end of the stick hydraulic cylinder.

The intelligent boom control hydraulic system can also include an energy storage system that stores excess energy and releases the stored energy to the intelligent boom control hydraulic system when needed. The microprocessor can compute control signals to direct storage of excess energy to and release of stored energy from the energy storage system. The energy storage system can include a hydraulic accumulator, an accumulator control valve and a plurality of hydraulic pressure sensors. The microprocessor can receive readings from the plurality of hydraulic pressure sensors, and compute control signals for the accumulator control valve. When operation of the intelligent boom control hydraulic system results in excess energy, the excess energy can be routed through the accumulator control valve and stored in the hydraulic accumulator. When the hydraulic accumulator has stored energy and operation of the intelligent boom control hydraulic system needs additional energy, the stored energy from the hydraulic accumulator can be routed through the accumulator control valve to the hoist and stick cylinders. When the hydraulic accumulator has stored energy and operation of the intelligent boom control hydraulic system needs additional energy, the stored energy from the hydraulic accumulator can be routed through the accumulator control valve to the base end of the hoist cylinder and the base end of the stick cylinder. The accumulator control valve can be coupled between the base end control valve and the hoist and stick counter-balance valves. The intelligent boom control hydraulic system can also include a one-way valve that couples the hydraulic fluid pump to the hydraulic accumulator through the hydraulic control valve, where the one-way control valve allows fluid to flow from the hydraulic fluid pump to the hydraulic control valve for energy storage in the hydraulic accumulator. The plurality of hydraulic pressure sensors can include a pump line pressure sensor, a reservoir line pressure sensor, a work line pressure sensor and an accumulator pressure sensor.

When retracting the hoist cylinder and extending the stick cylinder simultaneously, the hoist rod control valve can couple the hydraulic fluid pump to the rod end of the hoist cylinder activating the hoist counter balance valve and allowing hydraulic fluid to flow from the base end of the hoist cylinder to the base end of the stick cylinder extending the stick cylinder and pushing hydraulic fluid from the rod end of the stick cylinder through the stick rod control valve to the hydraulic reservoir. Any difference in oil volume needed at the stick cylinder versus what is available from the hoist cylinder to achieve a commanded boom tip motion can be either: a) added by connecting the hydraulic fluid pump to the base end of the stick cylinder through the base end control valve, or conversely b) removed by directing excess to the hydraulic reservoir or an energy storage device. The actuation of the appropriate valves can be controlled by algorithms running on the microprocessor, based on the operator commands, boom position readings and hydraulic circuit pressure readings.

When retracting the stick cylinder and simultaneously extending the hoist cylinder, the stick rod control valve can couple the hydraulic fluid pump to the rod end of the stick cylinder activating the stick counterbalance valve and allowing hydraulic fluid to flow from the base end of the stick cylinder to the base end of the hoist cylinder extending the hoist cylinder and pushing hydraulic fluid from the rod end of the hoist cylinder through the hoist rod control valve to the hydraulic reservoir. Any difference in oil volume needed at the hoist cylinder versus what is available from the stick cylinder to achieve the commanded boom tip motion can be either: a) added by connecting the hydraulic fluid pump to the base end of the hoist cylinder through the base end control valve, or conversely b) removed by directing excess to the hydraulic reservoir or energy storage device. The actuation of the appropriate valves can be controlled by algorithms running on the microprocessor, based on the operator commands, boom position readings and hydraulic circuit pressure readings.

Energy can be transferred between the base end of the hoist hydraulic cylinder and the base end of the stick hydraulic cylinder through the hoist counter-balance valve and the stick counter-balance valve. Energy can be transferred between the hoist and stick hydraulic cylinders and the hydraulic accumulator through the accumulator control valve.

DETAILED DESCRIPTION

Figure 1:
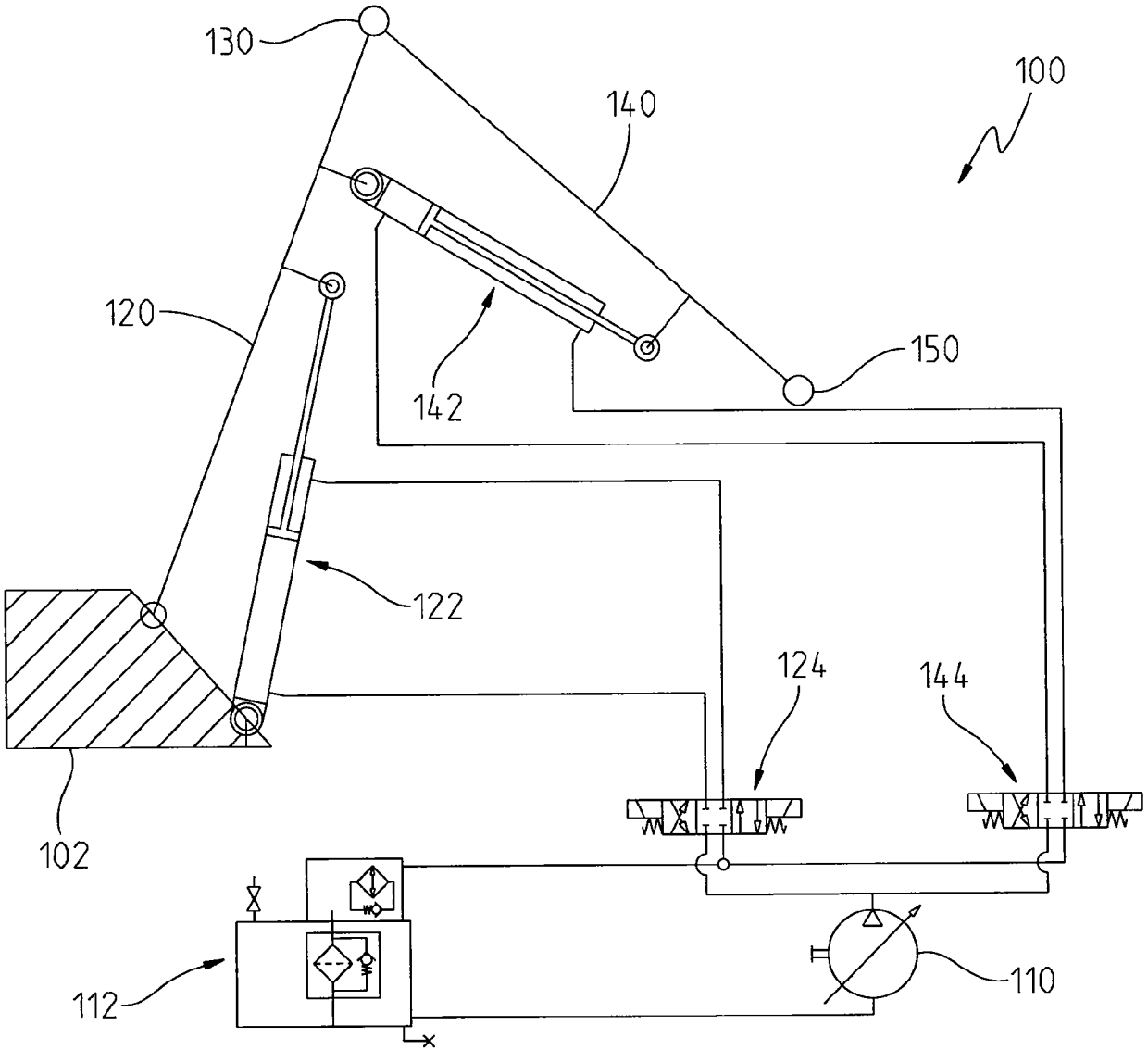
FIG. 1 illustrates an exemplary conventional knuckle boom hydraulic control system that only operates in joint mode.

For the purposes of promoting an understanding of the principles of the novel invention, reference will now be made to the embodiments described herein and illustrated in the drawings and specific language will be used to describe the same. It will nevertheless be understood that no limitation of the scope of the novel invention is thereby intended, such alterations and further modifications in the illustrated devices and methods, and such further applications of the principles of the novel invention as illustrated therein being contemplated as would normally occur to one skilled in the art to which the novel invention relates.

A boom system can be operated in several different modes. The following table summarizes operational modes enabled by the exemplary knuckle boom hydraulic systems illustrated in FIGS. 1-4.

| | Hydraulic Circuit | | | |
|---|---|---|---|---|
| Operation Mode | Conventional Circuit (FIG. 1) | Straight Line Circuit (FIG. 2) | IBC Circuit (FIG. 3) | IBC Circuit + Accumulator (FIG. 4) |
| Joint Mode (JM) | X | X | X | X |
| Rapid Cycle Mode (RC) | | X | | |
| Kinematic Mode (KM) | | | X | X |

The operational mode of the boom system is typically selected by the operator. In some current machines, operation in RC mode (sometimes referred to as "energy recovery" (ER) mode) allows some energy transfer between the booms, but operation in joint mode does not allow energy transfer between the booms. It would be desirable to have energy transfer between booms in any operational mode and/or to have microprocessor assistance to simplify control of boom system endpoint trajectories and velocities for machine operators.

FIG. 1 illustrates an exemplary conventional knuckle boom hydraulic control system 100 attached to a machine 102. The knuckle boom system 100 includes a main boom 120 attached to a stick boom 140 at a knuckle 130. The main boom 120 is powered by one or more main cylinder(s) 122, and the stick boom 140 is powered by one or more stick cylinder(s) 142. For clarity throughout the description of this and the other exemplary embodiments, an instance of a component will be described, for example a main cylinder 122 or a stick cylinder 142, it being understood that embodiments with multiple instances of that component, for example multiple main cylinders 122 and/or multiple stick cylinders 142, are also covered by the description.

The knuckle boom system 100 can only be operated in "joint mode" (JM) with oil flow separately controlled to the main cylinder 122 and the stick cylinder 142. A proximal end of the main boom 120 is attached to the machine 102, and a distal end of the main boom 120 is attached to a proximal end of the stick boom 140 at the knuckle 130. The proximal end of the stick boom 140 is attached to the main boom 120 at the knuckle 130, and a distal end of the stick boom 140 includes a boom tip 150 which can include a stick pin where an attachment can be attached to the knuckle boom system 100. An operator of the machine 102 can direct hydraulic oil flow from an oil reservoir 112, through a pump 110 to a hoist control valve 124 to extend and retract the main boom cylinder 122 causing the main boom 120 to raise and lower. The operator of the machine 102 can direct hydraulic oil flow from the oil reservoir 112, through the pump 110 to a stick control valve 144 to extend and retract the stick boom cylinder 142 causing the stick boom 140 to raise and lower.

For the conventional boom hydraulic circuit 100 when operated in JM, the operator inputs that control raising and lowering of the booms are taken as hydraulic flow signals directed to two actuators with minimal manipulation (i.e.

minimal ramping, curve shaping, etc). This arrangement results in inefficiency due to energy losses.

This arrangement also requires a significant level of operator skill to achieve linear constant velocity of the boom tip 150 since the tip velocity is constantly changing as a function of the cylinder speeds, as the tip moves through the boom operating envelope. In many applications, for example a feller buncher or an excavator, the operator wants to move the boom tip 150, and the attachment attached to the stick boom 140 at the stick pin, in a generally horizontal path. In these applications, it is desirable to make it easier for the operator to move the boom tip 150 in a generally horizontal path, and it would also be desirable to save energy while moving the boom tip 150 in the generally horizontal path. Moving the boom tip 150 in a generally horizontal path away from the machine 102 requires lowering the main boom 120 while simultaneously raising the stick boom 140. Thus, the operator would have to simultaneously coordinate movement of one joystick, or similar control mechanism, to control the main boom cylinder 122 through the hoist valve 124 and movement of another joystick, or similar control mechanism, to control the stick boom cylinder 142 through the stick control valve 144. The main boom 120 can be lowered by metering hydraulic fluid from the main boom cylinder 122 through an orifice in the hoist control valve 124 back into the oil reservoir 112. The energy released in lowering the main boom 120 is dissipated as heat into the hydraulic fluid. This then requires additional energy to be used for fans or other heat transfer apparatus to cool the hydraulic fluid as it passes through an oil cooling device. The stick boom 140 can be raised by pumping hydraulic fluid from the oil reservoir 112 through the pump 110 and the stick control valve 144 into the stick boom cylinder 142. This of course requires additional energy since the system 100 does not capture any of the energy from lowering the main boom 120 to raise the stick boom 140.

Figure 2:
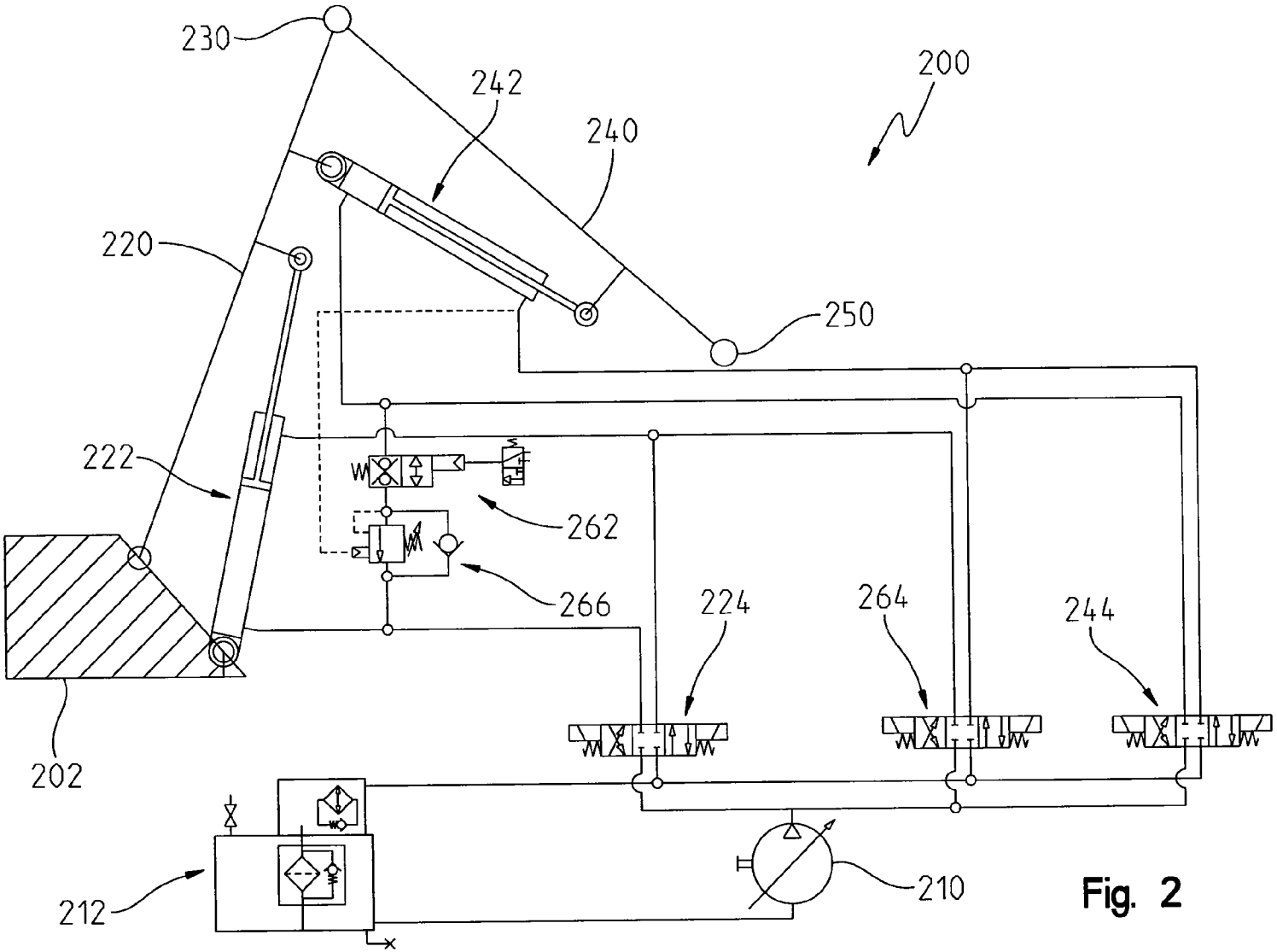
FIG. 2 illustrates an exemplary three valve knuckle boom system referred to herein as a straight line hydraulic circuit that can be operated in joint mode or in Rapid Cycle (RC) mode.

FIG. 2 illustrates an exemplary three valve knuckle boom system 200 referred to herein as a straight line hydraulic circuit that can be operated in joint mode (JM) or in Rapid Cycle (RC) mode. In RC mode, the system 200 provides near horizontal boom tip motion for a narrow elevation range, and provides some energy recovery. The knuckle boom system 200 is attached to a machine 202. The knuckle boom system 200 includes a main boom 220 attached to a stick boom 240 at a knuckle 230. The main boom 220 is powered by one or more main cylinder(s) 222, and the stick boom 240 is powered by one or more stick cylinder(s) 242. The knuckle boom system 200 can be operated in joint mode or RC mode and can transfer energy between the main cylinder 222, and the stick cylinder 242 in RC mode.

A proximal end of the main boom 220 is attached to the machine 202, and a distal end of the main boom 220 is attached to a proximal end of the stick boom 240 at the knuckle 230. The proximal end of the stick boom 240 is attached to the main boom 220 at the knuckle 230, and a distal end of the stick boom 240 includes a boom tip 250 that can include a stick pin where an attachment can be attached to the knuckle boom system 200. Hydraulic fluid is pressurized by a pump 210 which pulls the fluid from a reservoir 212. An operator of the machine 202 can direct hydraulic oil flow from the oil reservoir 212, through the pump 210 to a hoist control valve 224 to extend and retract the main boom cylinder 222 causing the main boom 220 to raise and lower. The operator of the machine 202 can also direct hydraulic oil flow from the oil reservoir 212, through the pump 210 to a stick control valve 244 to extend and retract the stick boom cylinder 242 causing the stick boom 240 to raise and lower.

The knuckle boom system 200 also includes a straight-line activation valve 262, a straight-line control valve 264 and a counter balance valve 266; the straight-line activation valve 262 and the counterbalance valve 266 directly coupling the hydraulic lines between the base end of the main boom cylinder 222 and the base end of the stick boom cylinder 242. With the straight line activation valve 262 activated, the operator can use the straight-line control valve 264 and counterbalance valve 266 to move the boom tip 250, and an attachment attached to the stick boom 240 at the boom tip 250, in a generally horizontal path while conserving energy.

Moving the boom tip 250 in a horizontal path away from the machine 202 requires lowering the main boom 220 while simultaneously raising the stick boom 240. This can be performed using one joystick mechanism controlling the straight line control valve 264. When the straight line activation valve 262 and control valve 264 are activated, pressurized hydraulic fluid from the pump 210 passes through the straight line control valve 264 into the rod end of the main boom cylinder 222, causing-the-main boom cylinder 222 to retract, pushing hydraulic fluid out of the base end of the main boom cylinder 222. When the straight-line activation valve 262 is activated and the hoist and stick control valves 224, 244 are in neutral position, the only available path for the hydraulic fluid exiting the base end of the main boom cylinder 222 is around the counterbalance valve 266 and straight-line activation valve 262 into the base end of the stick boom cylinder 242 which extends the stick boom cylinder 242 and raises the stick boom 240. Through kinematic design and optimization of cylinder sizes, the path of an attachment at the boom tip 250 can be configured to move in a near horizontal path parallel to the base of the machine 202. The velocity of the movement is determined by the hydraulic flow commanded through the straight line control valve 264 which is defined by the operator input.

Moving the boom tip 250 in a horizontal path towards the machine 202 requires raising the main boom 220 while simultaneously lowering the stick boom 240 which also can be performed using the joystick mechanism controlling the straight line control valve 264 along with the straight line activation valve 262 and the counterbalance valve 266.

In the knuckle boom system 200, functioning in RC mode, the operator controls the velocity of the boom tip with hydraulic fluid flow directed predominantly through one actuator which is hydraulically connected to a second actuator. The knuckle boom system 200 only provides straight-line operation in a narrow elevation range. When the straight-line activation valve 262 is not activated, the knuckle boom system 200 functions using the hoist and stick control valves 224, 244 as described with regard to FIG. 1 with the same inefficiencies of the knuckle boom system 100. This arrangement, when operated in RC mode has greater efficiency due to energy transfer between the booms. It would be desirable for a knuckle boom system to have a single operator control for straight-line mode at any elevation and/or for the knuckle boom system to recover energy from a lowering boom and use it to raise the other boom whether or not it is in the RC mode.

Figure 3:
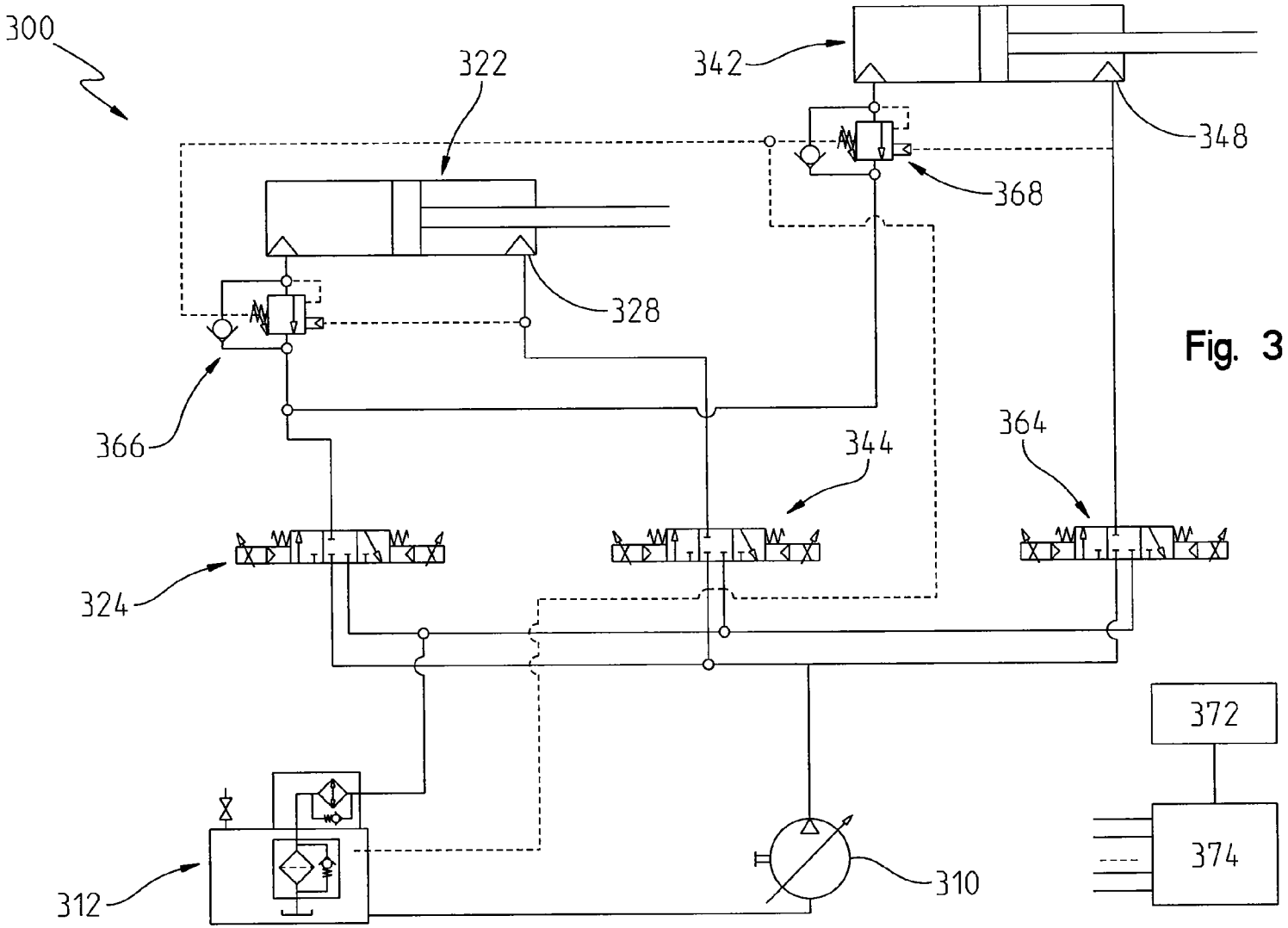
FIG. 3 illustrates an exemplary knuckle boom system referred to herein as an Intelligent Boom Control (IBC) hydraulic circuit that can be operated in a plurality of modes and transfers energy between the boom system cylinders in all operating modes.

FIG. 3 illustrates an exemplary Intelligent (knuckle) Boom Control (IBC) hydraulic system 300 that can be operated in a plurality of modes and transfers energy between the boom system cylinders in all operating modes. The IBC system 300 provides for a "kinematic control mode" (KM) that can provide straight-line horizontal or vertical motion or any combination of horizontal and vertical motion of the boom tip at any elevation. The knuckle boom IBC hydraulic system 300 includes one or more hoist cylinder(s) 322 powering a main boom and one or more stick cylinder(s) 342 powering a stick boom, the main boom and stick boom being attached to a machine and to one another at a knuckle as illustrated in FIGS. 1 and 2. The knuckle boom system 300 can be operated in JM or KM and can transfer energy between the hoist cylinder 322 and the stick cylinder 342 in all operating modes. The hoist cylinder 322 includes a position sensor 328 that can be used to determine the length of the hoist cylinder 322 and the position of the main boom. The stick cylinder 342 includes position sensor 348 that can be used to determine the length of the stick cylinder 342 and the position of the stick boom. Alternatively or in addition to the hoist and stick cylinder position sensors 328, 348, a main boom angle sensor can be placed at the main boom articulation point to determine the position of the main boom and/or a stick boom angle sensor can be placed at the stick boom articulation point to determine the position of the stick boom.

The knuckle boom system 300 also includes a hoist and stick base end control valve 324, a hoist rod control valve 344, a stick rod control valve 364, a hoist counter balance valve 366 and a stick counter balance valve 368. When operating the knuckle boom system 300, two of the control valves (base end control valve 324, hoist rod control valve 344, and stick rod control valve 364) are activated; one to let hydraulic fluid in and another to let hydraulic fluid out. Hydraulic fluid can be provided using a hydraulic pump 310 and released to a hydraulic reservoir 312 as needed.

The knuckle boom system 300 also includes operator input controls 372 coupled to a microprocessor 374. The microprocessor 374 can also receive inputs from sensors in the electro-hydraulic system including the hoist and stick cylinder position sensors 328, 348 and/or the main boom and stick boom angle sensors. For clarity, the connections between the microprocessor 374 and the individual sensors of the electro-hydraulic system are not shown. When operating the IBC system 300 in the kinematic control mode, the operator can input commands to define boom tip velocity using the operator input controls 372. To achieve smooth and constant velocities in this non-linear kinematic system, an algorithm running on the microprocessor 374 can receive the operator input commands from the operator input controls 372 and combine them with readings from the hoist and stick cylinder position sensors 328, 348, to compute input values for the control valves which direct hydraulic oil flow to achieve the commanded motion. The IBC system 300 can also be operated in joint mode (JM) with the efficiency advantages of the straight line hydraulic circuit (see FIG. 2) when being operated in RC mode.

For example, to extend the hoist cylinder 322 (raising the main boom) alone, hydraulic fluid is pumped from the pump 310 through the base end control valve 324 (left position) around the hoist counter balance valve 366 and into the base end of the hoist cylinder 322 which pushes hydraulic fluid out of the rod end of hoist cylinder 322 through the hoist rod control valve 344 (right position) into the hydraulic reservoir 312. For example, to extend the stick cylinder 342 (raising the stick boom) alone, hydraulic fluid is pumped from the pump 310 through the base end control valve 324 (left position) around the stick counter balance valve 368 and into the base end of the stick cylinder 342 which pushes hydraulic fluid out of the rod end of the stick cylinder 342 through the stick rod control valve 364 (right position) into the hydraulic reservoir 312.

The knuckle boom system 300 enables the transfer of energy between the main boom system and the stick boom system in either joint mode or kinematic mode of operation. For example, to retract the hoist cylinder 322 (lowering the main boom) and extend the stick cylinder 342 (raising the stick boom) simultaneously, hydraulic fluid is pumped from the pump 310 through the hoist rod control valve 344 (left position) into the rod end of the hoist cylinder 322 which activates the hoist counter balance valve 366 and allows hydraulic fluid out of the base end of the hoist cylinder 322 through the hoist counter balance valve 366 around the stick counter balance valve 368 and into the base end of the stick cylinder 342 which extends the stick boom and pushes hydraulic fluid out of the rod end of the stick cylinder 342 through the stick rod control valve 364 (right position) and back to the hydraulic reservoir 312. The potential energy released by the lowering of the main boom is transferred through the hydraulic fluid to increase the potential energy of the stick boom.

For example, to retract the stick cylinder (lowering the stick boom) and simultaneously extend the hoist cylinder 322 (raising the main boom), hydraulic fluid is pumped from the pump 310 through the stick rod control valve 364 (left position) into the rod end of the stick cylinder 342 which opens the stick counterbalance valve 368 and pushes hydraulic fluid out of the base end of the stick cylinder 342 through the stick counterbalance valve 368 around the hoist counterbalance valve 366 and into the base end of the hoist cylinder 322 which extends the main boom and pushes hydraulic fluid out of the rod end of the hoist cylinder 322 through the hoist rod control valve 344 (right position) and back to the hydraulic reservoir 312. In this case the potential energy released by the stick boom is transferred to the main boom.

Figure 4:
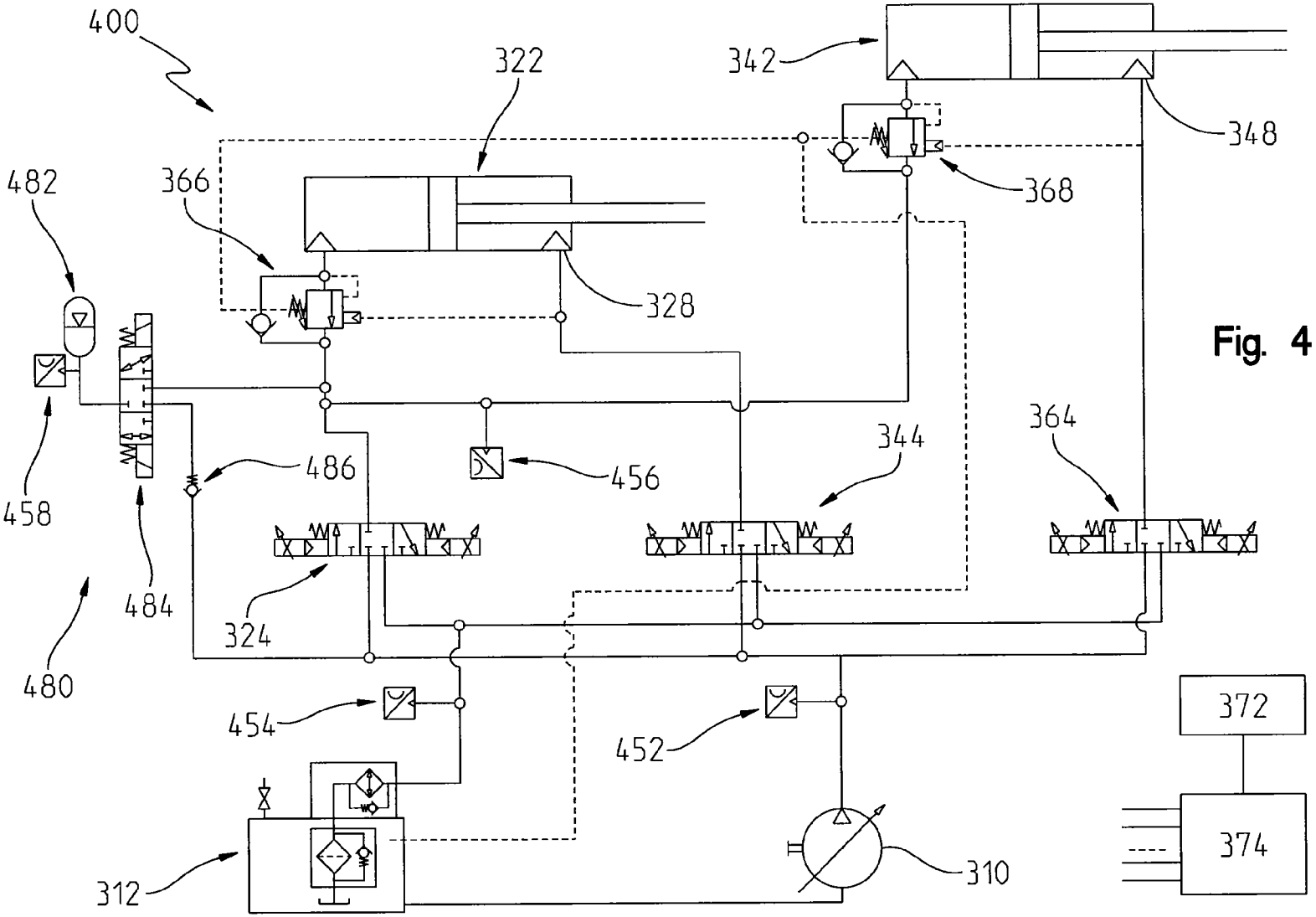
FIG. 4 illustrates an exemplary intelligent knuckle boom system similar to the IBC system of FIG. 3 that also includes pressure sensors and an energy storage system that can store excess energy when it is available and release it to the boom system when needed.

FIG. 4 illustrates an exemplary Intelligent (knuckle) Boom Control (IBC) system 400 that is similar to the system 300 but also includes an energy storage system 480 that can store excess energy and release it to the boom system when an energy deficiency occurs. The energy storage system 480 includes a hydraulic accumulator 482, an accumulator control valve 484 and a one-way valve 486. The knuckle boom system 400 also includes several pressure sensors strategically placed throughout the hydraulic circuit to identify energy needs and availability. The embodiment of FIG. 4 shows a pump line pressure sensor 452, a reservoir line pressure sensor 454, a work line pressure sensor 456 and an accumulator pressure sensor 458. To achieve smooth and constant velocities in this non-linear kinematic system, an algorithm running on the microprocessor 374 can receive operator input commands, combine them with inputs from the hoist and stick cylinder position sensors 328, 348 and with the inputs from the pressure sensors 452, 454, 456 and 458 in the hydraulic circuit, and compute input values for the control valves which then direct hydraulic oil flow to achieve the commanded motion and to direct oil flow to the accumulator 482 for energy storage and/or from the accumulator 482 for energy recovery to power the boom motion.

When operation of the knuckle boom system 400 results in excess energy, instead of releasing the energy as heat into the hydraulic oil returned to the reservoir 312, the system 400 can pass the energy through the accumulator control valve 484 to be stored in the hydraulic accumulator 482. In instances where the hydraulic accumulator 482 has stored energy, the IBC system 400 can use this energy instead of, or in addition to, energy from the pump 310. When the boom system is not in full use, the accumulator can be "charged" with energy through the one way valve 486 and the accumulator control valve 484 from the pump 310. The sequences for when to store and/or release energy can be controlled by the microprocessor 374 based on sensor inputs and programmed logic.

The exemplary IBC hydraulic knuckle boom systems illustrated in FIGS. 3 and 4 allow either kinematic mode operation or joint mode operation of an IBC system for any machine requiring coordinated movements in a multiple boom system with reduced hardware versus today's conventional solutions. These exemplary IBC hydraulic systems also enable efficiency benefits including flow conservation and/or energy recovery when multi-functioning in joint mode as well as when operating in kinematic mode. The IBC hydraulic circuits allow energy to be transferred from one boom to the other and reduce the total pump flow required to operate the boom system. This makes more oil flow and energy available for other simultaneously actuated functions resulting in overall improved machine efficiency and/or productivity. Additionally, an accumulator can be added to the circuit to recover and store energy when available from a boom and/or load that is being lowered or from the pump system, so that the energy can be re-introduced to the system when it is needed.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains.

We claim:

1. An intelligent boom control hydraulic system for a knuckle boom system including a main boom and a stick boom coupled at a knuckle; the intelligent boom control hydraulic system comprising:

a hoist hydraulic cylinder for raising and lowering the main boom, the hoist hydraulic cylinder having a rod end and a base end;

a stick hydraulic cylinder for raising and lowering the stick boom, the stick hydraulic cylinder having a rod end and a base end;

a hoist boom position sensor providing hoist boom position readings;

a stick boom position sensor providing stick boom position readings;

a hydraulic fluid pump;

a hydraulic reservoir including hydraulic fluid;

a base end control valve controlling flow from the hydraulic fluid pump to the base ends of the hoist and stick hydraulic cylinders, and controlling flow from the base ends of the hoist and stick hydraulic cylinders to the hydraulic reservoir;

a hoist rod control valve controlling flow from the hydraulic fluid pump to the rod end of the hoist hydraulic cylinder, and controlling flow from the rod end of the hoist hydraulic cylinder to the hydraulic reservoir;

a stick rod control valve controlling flow from the hydraulic fluid pump to the rod end of the stick hydraulic cylinder, and controlling flow from the rod end of the stick hydraulic cylinder to the hydraulic reservoir;

an operator input device for input of operator commands; and a microprocessor computing control signals to direct flow through the base end control valve, the hoist rod control valve and the stick rod control valve based on the operator commands and the hoist and stick boom position readings.

2. The intelligent boom control hydraulic system of claim 1, wherein during operation at least two of the base end control valve, the hoist rod control valve and the stick rod control valve are activated, one of the activated valves coupling the stick or hoist hydraulic cylinder to the hydraulic fluid pump and the other of the activated valves coupling the stick or hoist hydraulic cylinder to the hydraulic reservoir.

3. The intelligent boom control hydraulic system of claim 1, further comprising a hoist counter-balance valve controlling flow between the base end control valve and the base end of the hoist hydraulic cylinder.

4. The intelligent boom control hydraulic system of claim 1, further comprising a stick counter-balance valve controlling flow between the base end control valve and the base end of the stick hydraulic cylinder.

5. The intelligent boom control hydraulic system of claim 1, wherein the hoist boom position sensor is a hoist cylinder position sensor determining the length of the hoist hydraulic cylinder.

6. The intelligent boom control hydraulic system of claim 5, wherein the stick boom position sensor is a stick cylinder position sensor determining the length of the stick hydraulic cylinder.

7. The intelligent boom control hydraulic system of claim 1, further comprising a hoist counter-balance valve controlling flow between the base end control valve and the base end of the hoist hydraulic cylinder, and a stick counter-balance valve controlling flow between the base end control valve and the base end of the stick hydraulic cylinder.

8. The intelligent boom control hydraulic system of claim 7, wherein when retracting the hoist cylinder and extending the stick cylinder simultaneously, the hoist rod control valve couples the hydraulic fluid pump to the rod end of the hoist cylinder activating the hoist counter balance valve and allowing hydraulic fluid to flow from the base end of the hoist cylinder to the base end of the stick cylinder extending the stick cylinder and pushing hydraulic fluid from the rod end of the stick cylinder through the stick rod control valve to the hydraulic reservoir.

9. The intelligent boom control hydraulic system of claim 7, wherein when retracting the stick cylinder and simultaneously extending the hoist cylinder, the stick rod control valve couples the hydraulic fluid pump to the rod end of the stick cylinder activating the stick counterbalance valve and allowing hydraulic fluid to flow from the base end of the stick cylinder to the base end of the hoist cylinder extending the hoist cylinder and pushing hydraulic fluid from the rod end of the hoist cylinder through the hoist rod control valve to the hydraulic reservoir.

10. The intelligent boom control hydraulic system of claim 1, further comprising an energy storage system for storing excess energy and releasing the stored energy; the microprocessor computing control signals to direct storage of excess energy and release of stored energy.

11. The intelligent boom control hydraulic system of claim 10, wherein the energy storage system comprises a hydraulic accumulator, an accumulator control valve and a plurality of hydraulic pressure sensors; the microprocessor receiving readings from the plurality of hydraulic pressure sensors and computing control signals for the accumulator control valve.

12. The intelligent boom control hydraulic system of claim 11, wherein when operation of the intelligent boom control hydraulic system results in excess energy, the excess energy is routed through the accumulator control valve and stored in the hydraulic accumulator; and wherein when the hydraulic accumulator has stored energy and operation of the intelligent boom control hydraulic system needs additional energy, the stored energy from the hydraulic accumulator is routed through the accumulator control valve to the hoist and stick cylinders.

13. The intelligent boom control hydraulic system of claim 12, wherein when the hydraulic accumulator has stored energy and operation of the intelligent boom control hydraulic system needs additional energy, the stored energy from the hydraulic accumulator is routed through the accumulator control valve to the base end of the hoist cylinder and the base end of the stick cylinder.

14. The intelligent boom control hydraulic system of claim 11, further comprising a one-way valve coupling the hydraulic fluid pump to the hydraulic accumulator through the hydraulic control valve, the one-way control valve allowing fluid to flow from the hydraulic fluid pump to the hydraulic control valve for energy storage in the hydraulic accumulator.

15. The intelligent boom control hydraulic system of claim 11, wherein the plurality of hydraulic pressure sensors comprises a pump line pressure sensor, a reservoir line pressure sensor, a work line pressure sensor and an accumulator pressure sensor.

16. The intelligent boom control hydraulic system of claim 11, further comprising a hoist counter-balance valve controlling flow between the base end control valve and the base end of the hoist hydraulic cylinder, and a stick counter-balance valve controlling flow between the base end control valve and the base end of the stick hydraulic cylinder.

17. The intelligent boom control hydraulic system of claim 16, wherein the accumulator control valve is coupled between the base end control valve and the hoist and stick counter-balance valves.

18. The intelligent boom control hydraulic system of claim 17, further comprising a one-way valve coupling the hydraulic fluid pump to the hydraulic accumulator through the accumulator control valve, the one-way control valve allowing fluid to flow from the hydraulic fluid pump to the accumulator control valve for energy storage in the hydraulic accumulator.

19. The intelligent boom control hydraulic system of claim 18, wherein energy can be transferred between the base end of the hoist hydraulic cylinder and the base end of the stick hydraulic cylinder through the hoist counter-balance valve and the stick counter-balance valve.

20. The intelligent boom control hydraulic system of claim 19, wherein energy can be transferred between the hoist and stick hydraulic cylinders and the hydraulic accumulator through the accumulator control valve.

* * * * *